United States Patent [19]

Lauriello et al.

[11] 4,387,946

[45] Jun. 14, 1983

[54] MULTIPIN COUPLER

[75] Inventors: Alfred F. Lauriello, Plano; Steven D. Swendrowski, The Colony, both of Tex.

[73] Assignee: Mostek Corporation, Carrollton, Tex.

[21] Appl. No.: 273,843

[22] PCT Filed: Dec. 24, 1980

[86] PCT No.: PCT/US80/01726

§ 371 Date: Dec. 24, 1980

§ 102(e) Date: Dec. 24, 1980

[87] PCT Pub. No.: W082/02286

PCT Pub. Date: Jul. 8, 1982

[51] Int. Cl.[3] ..... H01R 13/631; H01R 13/631

[52] U.S. Cl. ..... 339/66 M

[58] Field of Search ..... 339/6, 8, 64 R, 64 M, 339/65, 66, 176 M

[56] References Cited

U.S. PATENT DOCUMENTS 3,668,608 6/1972 Ziegler ..... 339/64 M

FOREIGN PATENT DOCUMENTS 712880 1/1980 U.S.S.R. ..... 339/64 M

*Primary Examiner*—Eugene F. Desmond

[57] ABSTRACT

A multipin coupler (50) includes upper and lower ring members (52, 54) with a plurality of cooperating pin connections (76) surrounding central openings therethrough such that the circuitry and corresponding probe card for testing an IC chip can be interconnected through leads of the same lengths having uniform impedances. Guide pins (68) are provided to assure proper alignment of the ring members (52, 54) before engagement of the pin connections (76). A pin and slot connection supports the upper ring member (52) for limited movement relative to the lower ring member (54) for adjustability.

3 Claims, 6 Drawing Figures

MULTIPIN COUPLER

TECHNICAL FIELD

The present invention relates generally to the testing of semiconductor devices, and more particularly to a multipin coupler for interconnecting the test circuitry and probe card of a prober unit utilized to test a wafer of integrated circuit (IC) chips.

BACKGROUND ART

In the semiconductor industry, IC chips or dice are typically fabricated in flat wafers having diameters of several inches. Each wafer contains hundreds of chips which are individually tested before the wafer is scribed to separate the chips for further assembly.

Such testing is conducted by means of a prober unit which usually includes a base plate with an opening therein, a movable chuck located beneath the base plate opening, a microscope positioned above the base plate opening, together with associated testing circuitry and controls. The wafer of dice to be tested is secured to the chuck which is selectively movable in a vertical direction along the Z axis as well as in a horizontal direction along the X and Y axes. A generally circular probe card having multiple probes terminating in a predetermined pattern corresponding to the contacts on the chips is positioned within the base plate opening for rotational movement in a $\theta$ direction about the Z axis. In manual prober units, relative movement between the probe card and wafer is controlled by the operator. In automatic prober units, it is controlled by motors and a programmable microprocessor. An ink jet is usually provided to selectively spray the chip being tested.

The probe card and test circuitry are electrically interconnected by a multipin coupler which typically has included a lower portion fixed to the probe card and an upper portion fixed to a movable housing enclosing the test circuitry. After the probe card and wafer have been aligned, which is done by the operator looking through the microscope with the aid of spaced apart dummy chips on the wafer, the X, Y and Z increments necessary to step from chip to chip are then programmed into the microprocessor controlling the motorized chuck so that the chips can individually be brought into precise engagement with the probe card for testing. Those chips which test bad are marked with the ink jet.

Several difficulties have been encountered with the multipin couplers of the prior art. The couplers available heretofore have contributed some inaccuracies to the testing operation by reason of the variable impedances accompanying electrical connections of different lengths between the probe card and test circuitry. It will be appreciated that numerous leads are necessary to interconnect the probe card and test circuitry. In addition, since it is often necessary to disconnect the coupler during testing of a wafer in order to clean the probes on the probe card, clear the ink jet, etc., it is important that such be accomplished without disturbing and thus misaligning the probe card. It will be appreciated that a misaligned probe card can damage or destroy dice and requires realignment, which can be time consuming and thus expensive. Further, the couplers of the prior art have configurations which interfere with the operator's view of the wafer during probing and do not adequately provide either for adjustability or alignment between the coupler portions to avoid damaging the pins upon reconnection.

A need thus exists for a new and improved multipin coupler for interconnecting the probe card and test circuitry of a semiconductor chip test prober unit.

SUMMARY OF INVENTION

The present invention comprises a multipin coupler which overcomes the foregoing and other difficulties associated with the prior art. In accordance with the invention, there is provided a coupler for use in an IC chip test probing unit to interconnect the check out circuitry and probe card by means of multiple electrical paths of constant length and thus impedance without interfering with the operator's view of the chip being tested. The multipin coupler herein is also adapted to facilitate proper alignment between the coupler portions without damaging the pins thereon.

More particularly, an illustrated embodiment of the invention provides multipin coupler for use in a IC chip probing unit. The coupler includes a pair of ring members having central openings therethrough surrounded by a plurality of apertures within which cooperating pin connections are located. The lower ring and probe card are secured to a hub which rotates to provide adjustment in the $\theta$ direction relative to an underlying wafer. The upper ring is secured to a plate by means of pin and slot connections allowing it to be adjusted in the $\theta$, X, Y and Z directions relative to the lower ring. The ring members also include guide pins and associated receivers for assuring proper alignment therebetween. The multipin coupler construction herein enables electrical paths of constant length, and thus uniform impedance, to be maintained between the test circuitry surrounding the upper ring and the probe card beneath the lower ring without interfering with the operator's view of the chip being tested.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
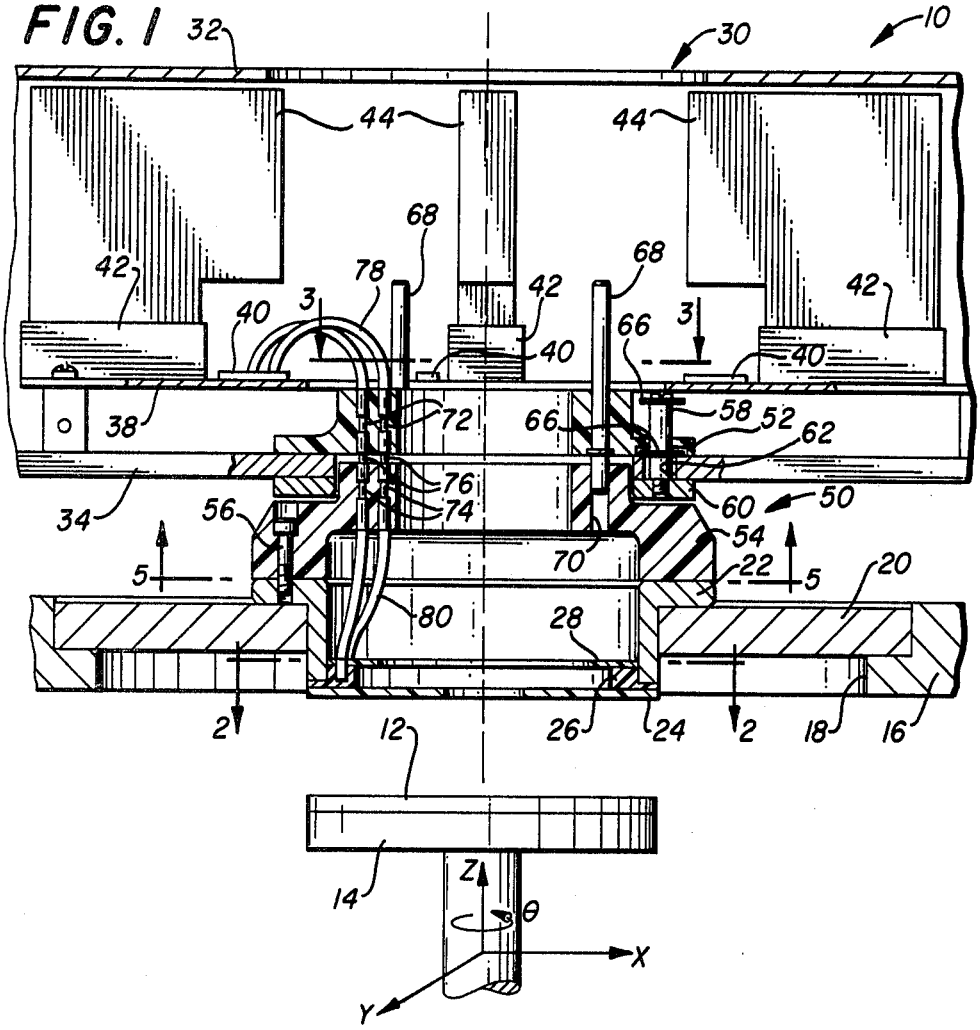
FIG. 1 is a partial elevational view of an IC chip test probing unit incorporating the multipin coupler of the invention.

Referring now to the Drawings, wherein like reference numerals designate corresponding parts throughout the views, there is shown a portion of a probing unit 10 for individually testing the IC chips or dice on a wafer 12. Wafer 12 is attached to a chuck 14 mounted for movement along the axes X and Y in a horizontal direction, along the axis Z in a vertical direction, and around axis Z in a rotational direction $\theta$. Chuck 14 of probing unit 10 is located beneath a fixed base plate 16 having a stepped opening 18 therein within which a mounting ring 20 is seated. A hub 22 is seated in ring 20 for rotational movement in the $\theta$ direction. Thumbscrews (not shown) or other suitable fasteners are preferably provided for locking hub 22 to ring 20 in the desired position.

Figure 2:
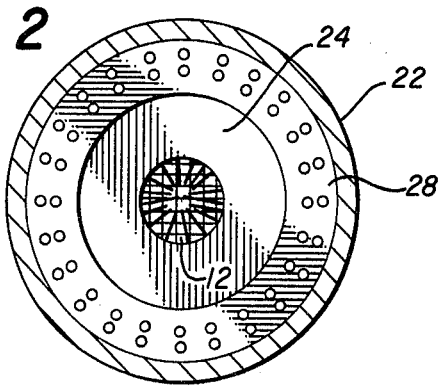
FIGS. 2 and 3 are sectional views taken along lines 2—2 and 3—3, respectively, of FIG. 1 in the direction of the arrows.

A probe card 24, adapter ring 26, and interface ring 28 are attached to the bottom of hub 22. As is best seen in FIG. 2, the probe card 24 includes a plurality of sharp probes which extend inward and terminate in a predetermined pattern corresponding to the contacts on the chips to be tested on wafer 12.

A chassis 30 supporting the particular components and circuitry required to test the chips on wafer 12 is located above mounting ring 20 and base plate 16. In most cases, chassis 30 would be mounted for movement relative to base plate 16 to facilitate access to probe card 24 and an ink jet (not shown) extending through ring 20 and hub 22 for marking the faulty chips on wafer 12. Chassis 30 includes a pair of upper and lower plates 32 and 34 having central openings therein aligned with the opening defined by hub 22. A microscope (not shown) extends into the opening in upper plate 32 for use by the operator of probing unit 10 during the testing operation.

Within chassis 30 there is an intermediate plate 38 with a central opening therein surrounded by a plurality of terminal strips 40, connectors 42, drivers 44 plugged into the connectors, and other components as well as associated wiring comprising the test circuitry for probing unit 10. Only three sets of terminal strips 40, connectors 42 and drivers 44 have been shown in FIG. 1 with the remaining components and all wiring being completely omitted therefrom for clarity. In actual practice, chassis 30 of probing unit 10 is interchangeable with other frames containing different circuitry, as probe card 24 is interchangeable with other probe cards, so that the unit can be readily adapted to test different IC chips.

Referring now to FIG. 1 in conjunction with FIGS. 3-6, the multipin coupler 50 of the invention is connected between chassis 30 and hub 22. Coupler 50 can be utilized with a conventional prober such as those available from Rucker & Kolls of Mountain View, Calif. Coupler 50 includes a pair of connector rings 52 and 54 each defining a central opening therethrough for the operator to view the probe card 24 and underlying wafer 12. Connector rings 52 and 54 can be formed of DELRIN brand synthetic material available from Du-Pont Company of Wilmington, Del. NORYL brand synthetic material available from General Electric Company of Selkirk, N.Y., plastic or any other suitable nonconductive material.

The lower connector ring 54 is rigidly secured to hub 22 by means of screws 56. As illustrated, ring 54 is mounted on a flange on the upper end of the hubs 22 which is seated in an opening in mounting ring 20. The probe card 24, adapter ring 26 and interface ring 28 are attached to the bottom end of hub 22 beneath ring 20. It will thus be understood that connector ring 54 and probe card 24 can be selectively rotated and secured in place in unison.

Figure 3:
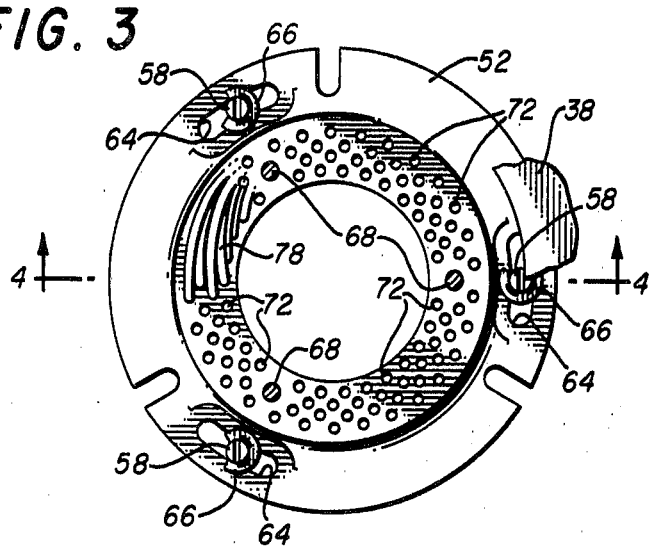
Figure 4:
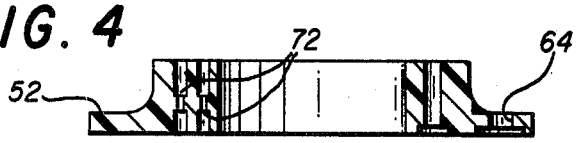
FIG. 4 is a sectional view taken along lines 4—4 of FIG. 3 in the direction of the arrows.
Figure 5:
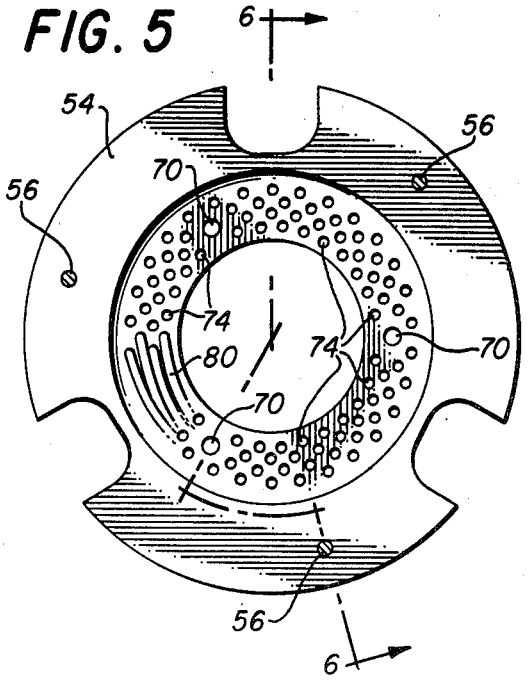
FIG. 5 is a sectional view taken along lines 5—5 of FIG. 1 in the direction of the arrows.
Figure 6:
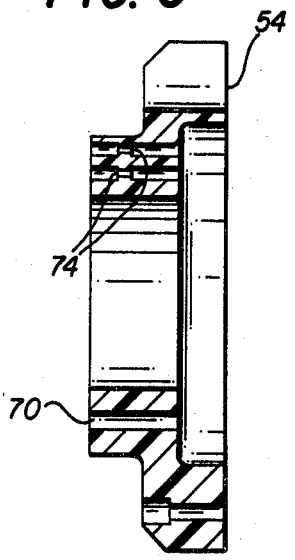
FIG. 6 is a sectional view taken along lines 6—6 of FIG. 5 in the direction of the arrows.

The upper connector ring 52 is loosely secured to lower plate 34 of chassis 30 by means of pins 58 and retainer rings 60. As is best seen in FIG. 1, plate 34 includes radially elongate slots 62 through which pins 58 extend to provide upper connector ring 52 with adjustability in the X and Y directions relative to lower connector ring 54. Slots 64 in upper connector ring 52, as is best seen in FIG. 3, are circumferentially elongate to provide adjustability in the $\theta$ direction. In addition, connector ring 52 is constrained between C-clips 66 on pins 58 for limited movement in the Z direction. Connector ring 52 is thus fully adjustable relative to connector ring 54.

Upper connector ring 52 further includes three guide pins 68 extending therethrough for receipt by corresponding openings 70 in lower connector ring 54. Guide pins 68 and their corresponding receiver openings 70 can be equally or unequally spaced circumferentially. That portion of pins 68 protruding downwardly from connector ring 52 is preferably longer than the protruding pin connectors on rings 52 and 54 to prevent engagement of the connector rings without proper alignment. Pins 68 thus function as locators and stops to prevent misalignment of connector rings 52 and 54 thereby avoiding potential damage to the pin connections therebetween. In the preferred embodiment, pins 60 are mounted in upper ring 52 while openings 70 are located in the lower ring 54, however, this order can be reversed if desired.

Surrounding the central openings in connector rings 52 and 54 are a plurality of multilevel holes 72 and 74, respectively, within which are provided pin connectors 76 comprised of mating male and female portions. In accordance with the preferred construction, pin connectors 76 comprise coaxial pin devices such as the Model D-602-18 and 19 devices available from Raychem Corp. of Menlo Park, Calif. The male and female portions of pin connectors 76 can be mounted in either ring 52 or ring 54. The portions of pin connectors 76 mounted in upper connector ring 52 are wired to terminal strips 40 by leads 78, all of which are of the same length. The opposite corresponding portions of pin connectors 76 in lower connector ring 54 are wired to interface ring 28 by means of leads 80 all of which are of the same length. Interface ring 28, adapter ring 26 and probe card 24 are electrically connected in well known fashion by contact pads on their confronting surfaces. The circular arrangement of rings 52 and 54 and their pin connectors 76 comprises another significant feature of the invention because leads 78 can all be of substantially equal length as can leads 80. The multiple electrical paths between interface ring 28 and terminal strips 40 are thus of uniform lengths so that the overall impedance between the test circuitry on chassis 30 and probe card 24 can be controlled.

In operation the multipin coupler 50 is connected as shown in FIG. 1. Should it become necessary to disconnect coupler 50, in order to clean the probes of probe card 24, for example, chassis 30 is raised and the lower C-clips 66 on pins 58 constrain the upper connector ring 52 such that it also raises away from lower connector ring 54 to disengage pin connectors 76 en masse. After the necessary work or adjustment has been performed, chassis 30 is lowered and the upper ring 52 floats between clips 66 on pins 58 while guide pins 68 prevent engagement with the lower ring 54. The operator can then rotate ring 52 within slots 64 and move it laterally as necessary within slots 62 until pins 68 drop into openings 70, after which the upper ring can be pushed downward by the operator to firmly reengage pin connectors 76 en masse so that probing of the dice on wafer 12 can continue.

From the foregoing, it will be apparent that the invention comprises an improved multipin coupler having several advantages over the prior art. The coupler herein enables interconnection of the test circuitry and probe card of an IC chip probing station through a plurality of electrical paths of equivalent lengths and therefore uniform impedances without interfering with the operator's view of the chip being tested. In addition, the coupler herein facilitates quick mass termination of the connection, and prevents damage to the pin connections by assuring proper alignment of the connector portions. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and rearrangements of elements falling within the scope of the invention as defined by the following claims.

We claim:

1. A multipin coupler for releasably connecting test circuitry to an IC chip probe card, comprising:

an upper ring member having a central opening therethrough;

a lower ring member having a central opening therethrough;

a plurality of pin connections with opposite mating portions mounted in said ring members around the openings therein;

means for aligning said ring members before engagement of said pin connections;

means for adjustably supporting said upper ring member for limited movement relative to said lower ring member; and a plurality of leads of substantially equivalent lengths interconnecting the test circuitry and probe card through said pin connections;

wherein said supporting means comprises:

a plate with an opening therein aligned with the openings in said ring members;

at least a portion of the test circuitry being supported on said plate;

a plurality of pins secured to said plate; and a pair of spaced apart stops secured to each pin on opposite sides of said upper ring member to allow axial movement thereof relative to the lower ring member.

2. The multipin coupler according to claim 1, further including:

a retainer ring fastened to said pins opposite said upper ring member, each pin extending through a radially elongate slot in said plate to allow transverse movement of said upper ring member relative to said lower ring member.

3. The multipin coupler according to claim 1 wherein each pin of said plurality of pins extends through a circumferentially elongate slot in said upper ring member to allow for rotational movement thereof relative to said lower ring member.

* * * * *